US006011946A

United States Patent [19]

Eddy et al.

[11] Patent Number: 6,011,946

[45] Date of Patent: Jan. 4, 2000

[54] FUSER MEMBER WITH POLYMER AND ZINC COMPOUND LAYER

[75] Inventors: Clifford O. Eddy, Webster; Arnold W. Henry, Pittsford; Samuel Kaplan, Walworth; Che C. Chow, Penfield; James B. Maliborski, Rochester, all of N.Y.

[73] Assignee: Xerox Corporation, Stamford, Conn.

[21] Appl. No.: 08/934,545

[22] Filed: Sep. 19, 1997

[51] Int. Cl.[7] ..... G03G 15/20

[52] U.S. Cl. ..... 399/333; 399/324

[58] Field of Search ..... 399/324, 325, 399/328, 329, 330, 333; 430/124, 99; 219/216; 118/60, DIG. 1; 492/53, 54, 56, 58, 59; 428/35.8, 36.91, 447, 411.1, 457, 461, 906, 421, 450, 451, 689, 913, 422, 463; 106/2

[56] References Cited

U.S. PATENT DOCUMENTS

| | | | |
|---|---|---|---|
| 4,101,686 | 7/1978 | Strella et al. | 118/60 X |
| 4,257,699 | 3/1981 | Lentz | 399/324 |
| 4,935,785 | 6/1990 | Wildi et al. | 399/324 |
| 5,248,339 | 9/1993 | Fitzgerald et al. | 118/60 |
| 5,292,606 | 3/1994 | Fitzgerald | 428/35.8 |
| 5,464,698 | 11/1995 | Chen et al. | 428/421 |
| 5,464,703 | 11/1995 | Ferrar et al. | 428/421 |
| 5,466,533 | 11/1995 | Fitzgerald et al. | 428/447 |
| 5,474,852 | 12/1995 | Fitzgerald et al. | 428/447 |
| 5,480,724 | 1/1996 | Fitzgerald et al. | 428/447 |
| 5,516,361 | 5/1996 | Chow et al. | 106/2 |
| 5,531,813 | 7/1996 | Henry et al. | 106/2 |
| 5,547,759 | 8/1996 | Chen et al. | 428/421 |
| 5,563,202 | 10/1996 | Ferrar et al. | 524/430 |
| 5,585,903 | 12/1996 | Mammino et al. | 399/308 |
| 5,587,245 | 12/1996 | Visser et al. | 428/447 |
| 5,595,823 | 1/1997 | Chen | 428/421 |
| 5,599,631 | 2/1997 | Chen | 428/421 |
| 5,663,224 | 9/1997 | Emmons et al. | 524/188 |
| 5,729,813 | 3/1998 | Eddy et al. | 399/333 |
| 5,736,250 | 4/1998 | Heeks et al. | 399/333 X |
| 5,781,840 | 7/1998 | Chen et al. | 399/324 |

*Primary Examiner*—Sophia S. Chen
*Attorney, Agent, or Firm*—Annette L. Bade

[57] ABSTRACT

A fuser member having a) a substrate; and thereover b) a filled polymeric outer layer with a zinc compound dispersed therein; and thereover c) a fluid release agent with molecules having amino functionality.

17 Claims, 3 Drawing Sheets

FUSER MEMBER WITH POLYMER AND ZINC COMPOUND LAYER

BACKGROUND OF THE INVENTION

The present invention relates to a fuser member and method for fusing toner images in an electrostatographic reproducing, including digital, apparatus. The present invention further relates to a method for preparation of such a fuser member. More specifically, the present invention relates to methods and apparatuses directed towards fusing toner images using a fuser member having a polymer layer with zinc compound dispersed or contained therein, and in preferred embodiments, the polymer and zinc compound layer is the outer layer of the fuser member. In a particularly preferred embodiment, the polymer/zinc compound fuser member outer layer is used in combination with functional release agents, and more specifically, amino functional release agents.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material cause it to be firmly bonded to the support.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The hot offset temperature or degradation of the hot offset temperature is a measure of the release property of the fuser, and accordingly it is desired to provide a fusing surface which has a low surface energy to provide the necessary release.

To ensure and maintain good release properties of the fuser, it has become customary to apply release agents to the fuser roll during the fusing operation. Typically, these materials are applied as thin films of, for example, silicone oils such as polydimethyl siloxane (PDMS), mercapto oils, amino oils, and other oils to prevent toner offset. The fuser oils may contain functional groups or may be non-functional.

Fillers have been added to the outer layer of fuser members in order to increase the bonding of the fuser oil to the surface of the fuser member to impart improved release properties.

U.S. Pat. No. 5,464,698 discloses a fuser member having a layer including a cured fluorocarbon random copolymer having subunits of vinylidene fluoride, hexafluoropropylene and tetrafluoroethylene, and having tin oxide fillers in combination with alkali metal oxides and/or alkali metal hydroxide fillers incorporated into the fuser layer. A polydimethylsiloxane release oil is disclosed.

U.S. Pat. No. 5,292,606 discloses a fuser roll having a base cushion layer comprising a condensation-crosslinked polydimethylsiloxane elastomer and having zinc oxide particles dispersed therein. A polydimethylsiloxane oil is also disclosed.

U.S. Pat. No. 5,464,703 discloses a fuser member having a base cushion layer including a crosslinked poly (dimethylsiloxane-fluoroalkylsiloxane) elastomer having tin oxide particles dispersed therein. A polydimethylsiloxane fuser oil is also disclosed.

U.S. Pat. No. 5,563,202 discloses a fuser member having a base cushion layer having a crosslinked poly (dimethylsiloxane-fluoroalkylsiloxane) elastomer having tin oxide particles dispersed therein. A polydimethylsiloxane fuser oil is also disclosed.

U.S. Pat. No. 5,466,533 discloses a fuser member having an overlying layer comprising a crosslinked polydiphenylsiloxane-poly(dimethylsiloxane) elastomer having zinc oxide particles dispersed therein. A polydimethylsiloxane fuser oil is also disclosed.

U.S. Pat. No. 5,474,852 discloses a fuser member having an overlying layer comprising a crosslinked polydiphenylsiloxane-poly(dimethylsiloxane) elastomer having tin oxide particles dispersed therein.

U.S. Pat. No. 5,480,724 discloses a fuser member having a base cushion layer comprising a condensation-crosslinked polydimethylsiloxane elastomer having tin oxide particles dispersed therein. A polydimethylsiloxane fuser oil is also disclosed.

U.S. Pat. No. 5,547,759 discloses a fuser member having a release coating comprising an outermost layer of fluoropolymer resin bonded to a fluoroelastomer layer by means of a fluoropolymer-containing polyamide-imide primer layer. Also disclosed is use of zinc oxide.

U.S. Pat. No. 5,595,823 discloses a fuser member having a layer including a cured fluorocarbon random copolymer having subunits of vinylidene fluoride, hexafluoropropylene and tetrafluoroethylene and having aluminum oxide filler along with alkali metal oxides and/or alkali metal hydroxide fillers incorporated into the fuser member layer. A polydimethylsiloxane and mercapto fuser oil are also disclosed.

U.S. Pat. No. 5,587,245 discloses a fuser member having an outer layer of an addition crosslinked polyorganosiloxane elastomer and zinc oxide particles dispersed therein. A polydimethylsiloxane fuser oil is also disclosed.

U.S. Pat. No. 5,531,813 discloses a polyorgano amino functional oil release agent having at least 85% monoamino functionality per active molecule to interact with the thermally stable FKM hydrofluoroelastomer surface of a fuser member. The patent discloses that no metal oxides are necessary to act as anchoring sites on the surface of the fuser member.

U.S. Pat. No. 5,516,361 discloses a T-type amino functional oil release agent having predominantly monoamino functionality per active molecule to interact with a hydrofluoroelastomer surface to provide release. The patent discloses that no metal oxides are necessary to act as anchoring sites on the surface of the fuser member.

It is important to choose the correct combination of fuser surface material, filler incorporated or contained therein, and fuser oil. Specifically, it is important that the outer layer of the fuser member react sufficiently with the selected fuser oil to obtain sufficient release. In order to improve the bonding of fuser oils with the outer surface of the fuser member, fillers have been incorporated into or added to the outer surface layer of the fuser members. The use of a filler can aid in decreasing the amount of fusing oil necessary by promoting sufficient bonding of the fuser oil to the outer surface layer of the fusing member However, it is important that the filler not degrade the physical properties of the outer layer of the fuser member, and further, it is important that the filler not cause too much of an increase the surface energy of the outer layer.

Other problems have resulted from use of fillers in that the oil may cause "gelling" or "scumming." "Gelling" or "scumming" is observed as whitish or grayish deposits on the fuser member surface left by paper debris as a result of its interaction with crosslinked fusing oil on the surface of the fuser member. The paper debris adheres to the fusing oil build-up and causes a "scum" or "gel" surface of the oil on the outer surface of the fuser member. The gelled or scummed areas on the fuser roll will attract toner particles leading to toner offset, and even in severe cases, to paper mis-strips or paper jams. "Gel" or "scum" forming on a fuser donor roll will lead to non-uniform oil application to the fuser roll and result in toner release problems such as toner offset, paper mis-strips and paper jams.

Another problem associated with the use of oils such as mercapto functional fusing oil, is the unpleasant odor produced by such oils. The use of mercapto oil, although providing sufficient toner release, has resulted in numerous and consistent customer complaints of foul odor.

Along with choosing the appropriate fusing oil in combination with the outer surface layer material and filler incorporated therein, efforts have been made to decrease the use of energy by providing a fuser member which has excellent thermal conductivity so as to reduce the temperature needed to promote fusion of toner to paper. This increase in thermal conductivity will also allow for increased speed of the fusing process by reducing the amount of time needed to sufficiently heat the fuser member to promote fusing. Efforts have also been made to increase the toughness of the fuser member layers in order to increase the layers' abrasion resistance and hence, the life of the fuser member.

Therefore, it is desirable to provide a fuser member having a combination of outer layer, filler and fusing oil, which decreases the occurrence of toner offset, gelling, scumming and adverse fusing oil odor. It is also desirable to provide a fuser member having an outer layer which provides for an increase in the fusing speed at a set temperature, or in the alternative, allows for use of a reduced temperature at normal or standard fusing speeds. It is further desirable to provide a fuser member which has an increased toughness in order to further the life of the fuser member.

SUMMARY OF THE INVENTION

In embodiments, the present invention relates to: a fuser member comprising: a) a substrate; and thereover b) a filled polymeric outer layer comprising a polymer having a zinc compound dispersed therein; and thereover c) a fluid release agent comprising molecules having amino functionality.

Embodiments of the present invention further include: an image forming apparatus for forming images on a recording medium comprising: a charge-retentive surface to receive an electrostatic latent image thereon; a development component to apply toner to said charge-retentive surface to develop said electrostatic latent image to form a developed image on said charge retentive surface; a transfer component to transfer the developed image from said charge retentive surface to a copy substrate; and a fuser member for fusing toner images to a surface of said copy substrate, wherein said fuser member comprises: a) a substrate; and thereover b) a filled polymeric outer layer comprising a polymer having a zinc compound dispersed therein; and thereover c) a fluid release agent comprising molecules having amino functionality.

BRIEF DESCRIPTION OF THE DRAWINGS

For a better understanding of the present invention, reference may be had to the accompanying figures.

DETAILED DESCRIPTION OF THE PRESENT INVENTION

Figure 1:
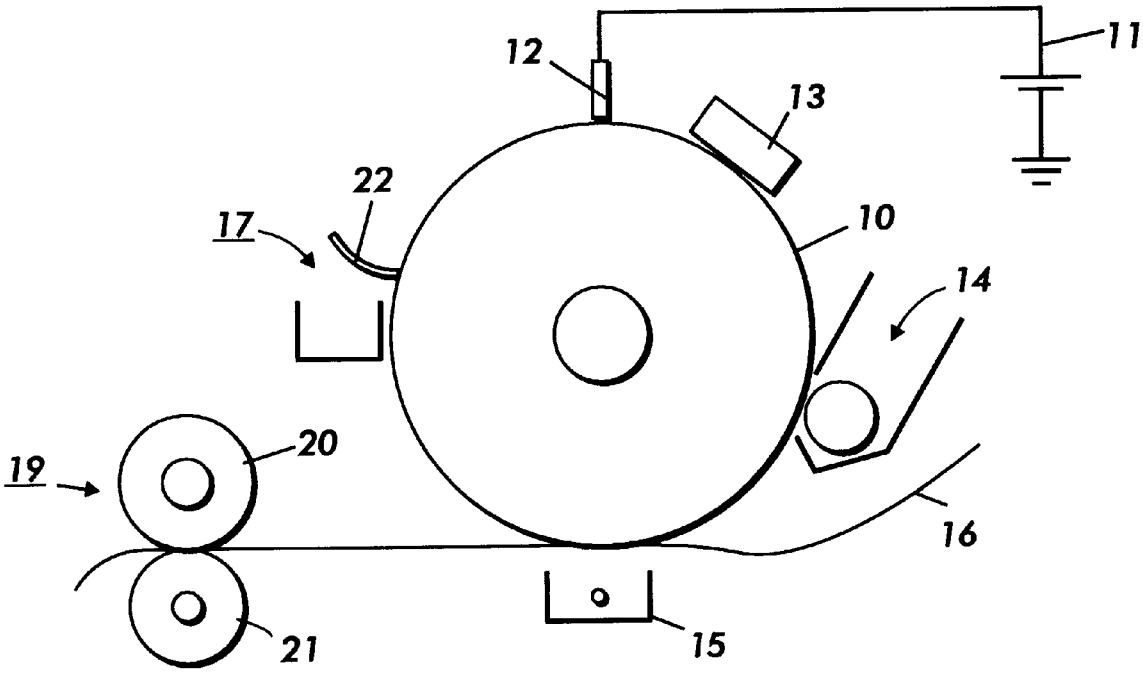
FIG. 1 is an illustration of a general electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
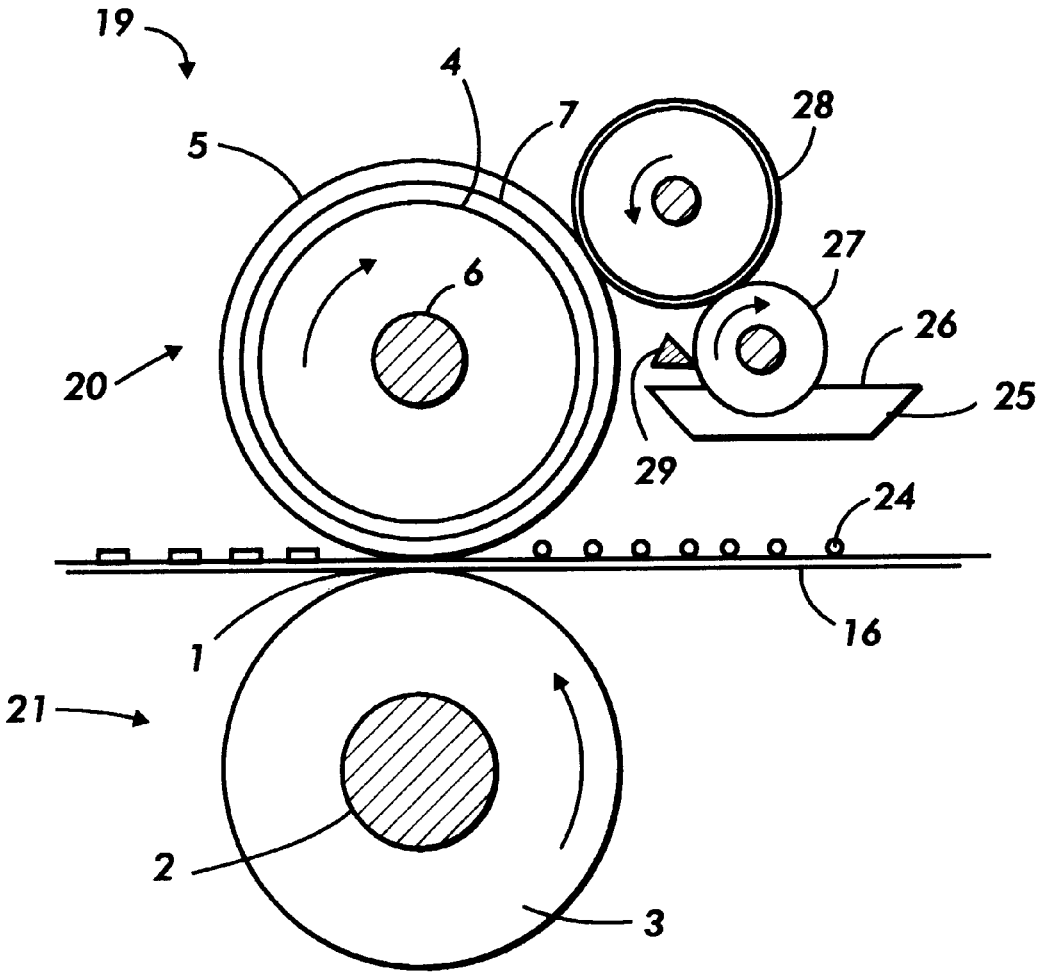
FIG. 2 illustrates a fusing system in accordance with an embodiment of the present invention.

Referring to FIG. 2, an embodiment of a fusing station 19 is depicted with an embodiment of a fuser roll 20 comprising polymer surface 5 upon a suitable base member 4, a hollow cylinder or core fabricated from any suitable metal, such as aluminum, anodized aluminum, steel, nickel, copper, and the like, having a suitable heating element 6 disposed in the hollow portion thereof which is coextensive with the cylinder. The fuser member 20 can include an adhesive, cushion, or other suitable layer 7 positioned between core 4 and outer layer 5. Backup or pressure roll 21 cooperates with fuser roll 20 to form a nip or contact arc 1 through which a copy paper or other substrate 16 passes such that toner images 24 thereon contact elastomer surface 5 of fuser roll 20. As shown in FIG. 2, an embodiment of a backup roll or pressure roll 21 is depicted as having a rigid steel core 2 with a polymer or elastomer surface or layer 3 thereon. Sump 25 contains polymeric release agent 26 which may be a solid or liquid at room temperature, but it is a fluid at operating temperatures. The pressure member 21 may include a heating element (not shown).

In the embodiment shown in FIG. 2 for applying the polymeric release agent 26 to polymer or elastomer surface 5, two release agent delivery rolls 27 and 28 rotatably mounted in the direction indicated are provided to transport release agent 26 to polymer or elastomer surface 5. Delivery roll 27 is partly immersed in the sump 25 and transports on its surface release agent from the sump to the delivery roll 28. By using a metering blade 29, a layer of polymeric release fluid can be applied initially to delivery roll 27 and subsequently to polymer or elastomer 5 in controlled thickness ranging from submicrometer thickness to thicknesses of several micrometers of release fluid. Thus, by metering device 29, preferably from about 0.1 to about 2 micrometers or greater thicknesses of release fluid can be applied to the surface of polymer or elastomer 5.

Figure 3:
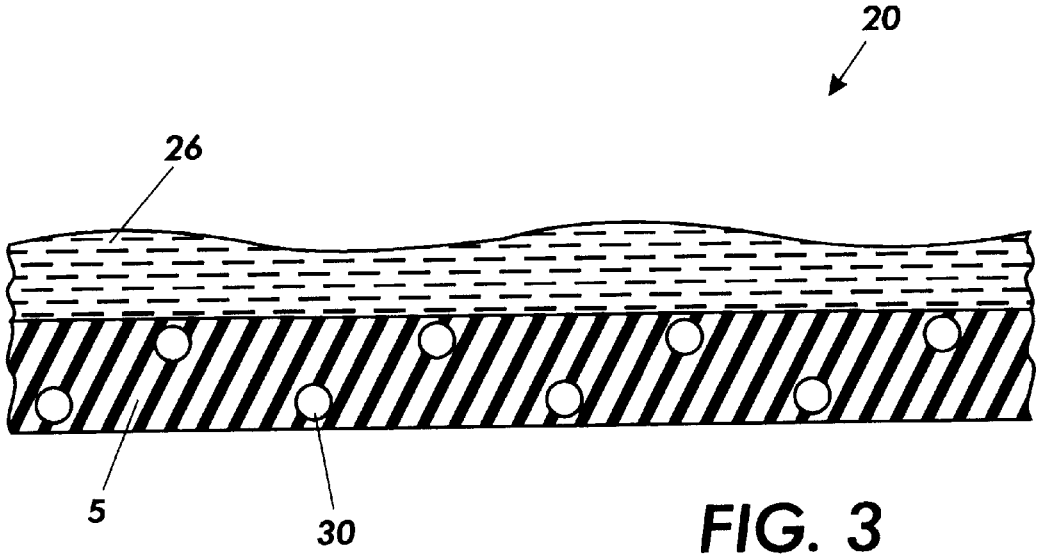
FIG. 3 demonstrates a cross-sectional view of an embodiment of the present invention.

FIG. 3 depicts a cross-sectional view of a preferred embodiment of the invention, wherein fuser member 20 comprises outer surface layer 5 comprising a polymer having zinc compound 30 dispersed therein, and wherein fusing oil 26 is deposited on the outer polymer surface layer 5.

Fuser member as used herein refers to fuser members including fusing rolls, belts, films, sheets and the like; donor members, including donor rolls, belts, films, sheets and the like; and pressure members, including pressure rolls, belts, films, sheets and the like; and other members useful in the fusing system of an electrostatographic or xerographic, including digital, machine. The fuser member of the present invention may be employed in a wide variety of machines and is not specifically limited in its application to the particular embodiment depicted herein.

Any suitable substrate may be selected for the fuser member. The fuser member substrate may be a roll, belt, flat surface, sheet, film, or other suitable shape used in the fixing of thermoplastic toner images to a suitable copy substrate. It may take the form of a fuser member, a pressure member or a release agent donor member, preferably in the form of a cylindrical roll. Typically, the fuser member is made of a hollow cylindrical metal core, such as copper, aluminum, stainless steel, or certain plastic materials chosen to maintain rigidity, structural integrity, as well as being capable of having a polymeric material coated thereon and adhered firmly thereto. It is preferred that the supporting substrate is a cylindrical sleeve having an outer polymeric layer of from about 1 to about 6 mm. In one embodiment, the core, which may be an aluminum or steel cylinder, is degreased with a solvent and cleaned with an abrasive cleaner prior to being primed with a primer, such as Dow Corning 1200, which may be sprayed, brushed or dipped, followed by air drying under ambient conditions for thirty minutes and then baked at 150° C. for 30 minutes.

Examples of suitable outer fusing layers of the fuser member herein include polymers such as fluoropolymers. Preferred are elastomers such as fluoroelastomers. Specifically, suitable fluoroelastomers are those described in detail in U.S. Pat. Nos. 5,166,031; 5,281,506; 5,366,772; 5,370,931; 4,257,699; 5,017,432; and 5,061,965, the disclosures each of which are incorporated by reference herein in their entirety. These fluoroelastomers, particularly from the class of copolymers, terpolymers, and tetrapolymers of vinylidenefluoride, hexafluoropropylene and tetrafluoroethylene and a possible cure site monomer, are known commercially under various designations as VITON A®, VITON E®, VITON E60C®, VITON E430®, VITON 910®, VITON GH® VITON GF®, VITON E45® and VITON B50®. The VITON® designation is a Trademark of E.I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII1900) a poly(propylene-tetrafluoroethylenevinylidenefluoride) both also available from 3M Company, as well as the TECNOFLONS® identified as FOR-60KIR®, FOR-LHF®, NM® FOR-THF®, FOR-TFS®, TH®, TN505® available from Montedison Specialty Chemical Company. In another preferred embodiment, the fluoroelastomer is one having a relatively low quantity of vinylidenefluoride, such as in VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

Other preferred outer surface layers include polymers containing ethylene propylene diene monomer (EPDM) such as, for example, those EPDM materials sold under the tradename NORDEL® available from DuPont, an example of which is NORDEL® 1440, and POLYSAR® EPDM 345 available from Polysar.

In addition, preferred outer surface layers include butadiene rubbers (BR) such as, for example, BUDENE® 1207 available from Goodyear, butyl or halobutyl rubbers such as, for example, EXXON Butyl 365, POLYSAR Butyl 402, EXXON Chlorobutyl 1068 and POLYSAR Bromobutyl 2030.

Other layers suitable for use herein include silicone rubbers. Preferably, the silicone layer would be present as an intermediate layer and a polymer, preferably a fluoroelastomer, containing a zinc compound would be present on the silicone intermediate layer. This configuration would be suitable for use in a nip forming fuser roll system.

Polymers such as FKM materials (e.g., fluoroelastomers and silicone elastomers) are preferred for use in high temperature applications, and EPDM, BR, butyl, and halobutyl materials are preferred for use in low temperature applications such as transfix and ink applications and for use with belts.

The amount of polymer composite used to provide the outer layer of the fuser member of the present invention is dependent on the amount necessary to form the desired thickness of the layer or layers of the fuser member. It is preferred that the outer fusing layer be coated to a thickness of from about 6 to about 12 mils, and preferably from about 7 to about 10 mils. Specifically, the polymer for the outer layer is added in an amount of from about 90 to about 55 volume per total volume percent, and preferably about 85 to about 75 volume per total volume percent. Total volume percent refers to the total volume percent of polymer and zinc compound.

Conductive fillers are dispersed in the outer fusing layer of the fuser member of the present invention. Preferred fillers are capable of interacting with the functional groups of the amino functional release agent to form a thermally stable film which releases the thermoplastic resin toner and prevents the toner from contacting the filler surface material itself. This bonding enables a reduction in the amount of amino functional oil needed to promote release. Further, preferred fillers promote bonding with the amino functional oil, without causing problems of scumming or gelling. In addition, it is preferred that the fillers be substantially non-reactive with the polymer material so that no adverse reaction occurs between the polymer material and the filler which would hinder curing or otherwise negatively affect the strength properties of the outer surface material. Zinc compounds, in embodiments, fulfill the above requirements and enable reaction with the functional amino oil without promoting scumming or gelling and without interfering with the desired mechanical properties of the outer surface material of the fuser member. Preferred zinc compounds include zinc oxide, zinc complex ions such as zinc-ammonia complex ion, zinc esters such as zinc stearate, zinc borate, zinc carbonate, zinc gallate, zinc orthophosphate, zinc metasilicate, zinc salts of carboxylic acids, zinc orthosilicate, zinc sulfate, zinc salts such as zinc halides, zinc sulfide, and the like zinc compounds. The zinc compounds can be platy or block-like.

The zinc compound is typically present in an amount of from about 10 to about 45 volume percent per total volume, although it is preferred to have from about 15 to about 25 volume percent per total volume. Total volume refers to the total volume of polymer and zinc compound.

In addition, the particle size of the zinc compound is preferably, not too small as to negatively affect the strength properties of the polymer, and not too large as to supply an insufficient number of particle to particle contacts and thereby adversely affect the thermal conductivity of the zinc compound filled polymer. Typically, the zinc compound particles have a particle size or mean diameter, as determined by standard methods, of from about 0.01 to about 20 micrometers, preferably about 1 to about 20 micrometers, and particularly preferred of from about 1 to about 8 micrometers. The zinc compound may be platy or plate-like shaped, or may be block-like. In the event that the zinc compound has a block-like particle shape, the particle size is preferably from about 0.1 to about 20 micrometers.

Other adjuvants and fillers may be incorporated in the elastomer in accordance with the present invention provided that they do not affect the integrity of the polymer material, and as long as they do not interfere with the bonding between the amino functional oil and the zinc compounds. Such fillers normally encountered in the compounding of elastomers include coloring agents, reinforcing fillers, and processing aids. Oxides such as magnesium oxide and hydroxides such as calcium hydroxide are suitable for use in curing many FKM polymers. Proton acids like stearic acid are suitable additives in EPDM and BR polymer formulations to improve release by improving bonding of amino oil to the elastomer composition.

Preferred polymeric fluid release agents to be used in combination with the polymer and zinc compound are those comprising molecules having functional groups which interact with the zinc compound particles in the fuser member in such a manner to form a layer of fluid release agent which results in an interfacial barrier at the surface of the fuser member while leaving a non-reacted low surface energy release fluid as an outer release film. Amino functionality is defined in that the release agent comprises molecules having at least one substituted amine group. Examples of suitable release agents comprising molecules having functional groups include amino functional oils, and preferably are amino functional polydimethylsiloxane (PDMS) release agents. Specific examples of suitable amino functional release agents include T-Type amino functional silicone release agents disclosed in U.S. Pat. No. 5,516,361; monoamino functional silicone release agents described in U.S. Pat. No. 5,531,813; and the amino functional siloxane release agents disclosed in U.S. Application Ser. No. 08/315,004, filed Sep. 29, 1994 now U.S. Pat No. 5,747,212; the disclosures each of which are incorporated herein in their entirety. The release agent may further comprise non-functional oil as diluent.

Specific examples of functional molecules of amino functional release agents useful in the present invention include those having the following Formula I:

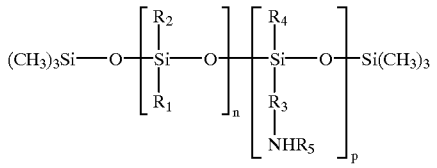

wherein $50 \leqq n \leqq 200$, p is from about 1 to about 5 and $R_1$, $R_2$, and $R_3$ are selected from the group consisting of alkyl and arylalkyl radicals having from about 1 to about 18 carbon atoms, $R_4$ is selected from the group consisting of alkyl and arylalkyl radicals having from about 1 to about 18 carbon atoms and a polyorganosiloxane chain having from about 1 to about 100 organosiloxy repeat units, and $R_5$ is selected from the group consisting of hydrogen, alkyl and arylalkyl radicals having from about 1 to about 18 carbon atoms; and functional molecules having the following Formula II:

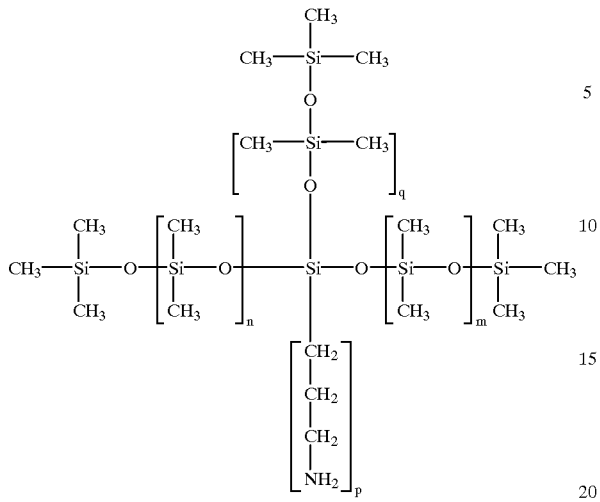

where $50 \leqq n \leqq 200$, p is from about 1 to about 5, $50 \leqq m \leqq 200$ and q is from about 1 to about 200. In preferred embodiments, at least about 30 percent or higher of the polyorganosiloxane molecules of Formulas I or 2, have only one substituted amino group per polyorganosiloxane molecule. In an even further preferred embodiment of the invention, from about 50 to about 99.9 percent of the polyorganosiloxane molecules of Formulas I or II have only one substituted amino group per polyorganosiloxane molecule.

The fuser members are useful in combination with many toners, including black and white toner or color toner. The fuser members are preferably useful with black and white toners as disclosed in U.S. Pat. No. 3,590,000, and color toners such as those disclosed in U.S. Pat. Nos. 5,376,494; 5,227,460; 3,655,374; 3,900,588; 4,937,166; 4,935,326; 5,406,357; 5,023,158; 5,004,666; 4,997,739; 4,988,598; 4,921,771; 5,229,242; and 4,917,982, the disclosures all of which are hereby incorporated by reference in their entirety.

The outer polymer layer of the present invention can be coated on the fuser member substrate by any means including normal spraying, dipping and tumble spraying techniques. A flow coating apparatus as described in U.S. Application Ser. No. 08/672,493 filed Jun. 26, 1996, entitled, "Flow Coating Process for Manufacture of Polymeric Printer Roll and Belt Components," the disclosure of which is hereby incorporated herein in its entirety, can also be used to flow coat a series of fuser rolls. It is preferred that the polymer be diluted with a solvent prior to application to the fuser substrate.

The zinc compound can be incorporated into the polymer and the solution ball or roll milled, if necessary, to ensure adequate mixture. Alternatively, other known procedures for mixing can be used. The resulting solution with any other optional filters and/or adjuvants can be coated onto an appropriate substrate such as a belt, film, sheet or roll. Preferably, the polymer/zinc coating solution is coated on a cylindrical metal roll.

Other layers such as adhesive layers or other suitable cushion layers or conductive layers may be incorporated between the outer polymer/zinc compound layer and the substrate.

Therefore, disclosed herein is a fuser member having a combination of outer layer, filler and fusing oil, which, in embodiments, decreases the occurrence of toner offset, gelling, scumming and adverse fusing oil odor. Also, a fuser member is disclosed which, in embodiments, has an outer layer which promotes an increase in the thermal conductivity in order to decrease the temperature necessary to heat the fuser member, or in an alternative embodiment, increases the thermal conductivity wherein no heat-up is necessary. The results are an increase in fusing speed. Also, disclosed herein is a fuser member which, in embodiments, has an increased toughness in order to further the life of the fuser member by increasing its abrasion resistance.

All the patents and applications referred to herein are hereby specifically, and totally incorporated herein by reference in their entirety in the instant specification.

The following Examples further define and describe embodiments of the present invention. Unless otherwise indicated, all parts and percentages are by weight of total solids as defined in the specification.

EXAMPLES

Example I

The following components were mixed together in a glass vial: 0.35 grams of Dow Corning (DC2-8783) amino fluid containing 0.06% mol amine; 7 grams of Zinc Corporation of America, US no. 1 Zinc Oxide; and 30 ml Fisher reagent grade hexanes. The mixture was vigorously shaken for about 2 hours. Subsequently, the mixture was centrifuged at 5,000 rpm for approximately 30 minutes. The supernatant containing amino fluid and hexanes was poured off, and the hexanes solvent was evaporated with a nitrogen gas stream for about 6 hours. The resulting amine fluid residue was redissolved into $CDCl_3$ for proton NMR determination of amine content.

Any interaction between the zinc oxide and amino functional groups in the amino oil should be demonstrated by a decrease of amine content in the supernatant fluid. The data shown in Table I demonstrates that the amine functionality is completely adsorbed (zero mol% remaining in the fluid) onto the zinc oxide. Thus, the zinc oxide is strongly interacting with the amine functionality.

Comparative Example II

The following components were mixed together in a glass vial: 0.35 grams of Dow Corning (DC2-8783) amino fluid containing 0.06 mol% amine; 7 grams of KC Abrasives No. 1 Alumina; and 30 ml Fisher reagent grade hexanes. The mixture was vigorously shaken for about 2 hours. Subsequently, the mixture was centrifuged at 5,000 rpm for approximately 30 minutes. The supernatant containing amino fluid and hexanes was poured off, and the hexanes solvent was evaporated with a nitrogen gas stream for about 6 hours. The resulting amine fluid residue was redissolved into $CDCl_3$ for proton NMR determination of amine content.

Any interaction between the alumina and amino functional groups should result in a decrease of amine content in the supernatant fluid. The data shown in Table I demonstrates that whereas the amine content is reduced to 0.022 mol% by adsorption to alumina in Example 2, the amine functionality is completely adsorbed (zero mol% remaining in the fluid) onto the zinc oxide in Example 1. Thus, the zinc oxide is more strongly interacting than the alumina with the amine functionality.

This data demonstrates that better release and longer release life should be achievable with rolls filled with zinc oxide in combination with amino functional oils.

| Example Number | Filler in combination with amino oil | Final Amine content (mol %) |
|---|---|---|
| Example I | zinc oxide | 0.00 |
| Comparative Example II | alumina | 0.022 |

Example 3

Zinc oxide in the form of blocky 0.12 micrometer particles from Zinc Corporation of America at 20 percent volume/volume was included in a standard bisphenol cured VITON® GF formulation. The resulting cured product had an isotropic thermal conductivity of 0.3 w/m-°K. The toughness was measured at 2990 in-lb/in$^3$.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

We claim:

1. A fuser member comprising: a) a substrate; and thereover b) a filled polymeric outer layer comprising a polymer having a zinc compound dispersed therein; and thereover c) a fluid release agent comprising amino functional polyorganosiloxane molecules, wherein at least about 30 percent of the polyorganosiloxane molecules in the fluid release agent have only one substituted amino group per polyorganosiloxane molecule.

2. A fuser member in accordance with claim 1, wherein said zinc compound is selected from the group consisting of a) zinc esters; b) zinc oxide; c) zinc halides; d) zinc complex ions; and e) zinc salts of carboxylic acids.

3. A fuser member in accordance with claim 2, wherein said zinc compound is zinc oxide.

4. A fuser member in accordance with claim 2, wherein said zinc compound is zinc-ammonia complex ion.

5. A fuser member in accordance with claim 1, wherein said zinc compound is a zinc ester.

6. A fuser member in accordance with claim 1, wherein said zinc compound has a particle size of from about 1 to about 20 micrometers.

7. A fuser member in accordance with claim 1, wherein said zinc compound has a block-like particle shape.

8. A fuser member in accordance with claim 7, wherein said zinc compound has a particle size of from about 0.1 to about 20 micrometers.

9. A fuser member in accordance with claim 1, wherein said zinc compound is present in the filled polymeric outer layer in an amount of from about 10 to about 45 volume percent per total volume of polymer and zinc compound.

10. A fuser member in accordance with claim 1, wherein said polymer is selected from the group consisting of a) polymers comprising ethylenediene propylene monomers; b) fluoropolymers; c) butyl rubbers; and d) butadiene rubbers.

11. A fuser member in accordance with claim 10, wherein said fluoropolymer is a fluoroelastomer selected from the group consisting of a) copolymers of vinylidenefluoride, hexafluoropropylene and tetrafluoroethylene, b) terpolymers of vinylidenefluoride, hexafluoropropylene and tetrafluoroethylene, and c) tetrapolymers of vinylidenefluoride, hexafluoropropylene, tetrafluoroethylene and a cure site monomer.

12. A fuser member in accordance with claim 11, wherein said fluoroelastomer comprises about 35 weight percent of vinylidenefluoride, about 34 weight percent of hexafluoropropylene, about 29 weight percent of tetrafluoroethylene and about 2 weight percent of a cure site monomer.

13. A fuser member in accordance with claim 1, wherein from about 50 to about 99.9 percent of the polyorganosiloxane molecules in the fluid release agent have only one substituted amino group per polyorganosiloxane molecule.

14. The fuser member in accordance with claim 1, wherein said amino functional groups of said polyorganosiloxane molecules of said fluid release agent react with said zinc compound so as to form a layer of fluid release agent over said outer layer of said fuser member.

15. The fuser member in accordance with claim 1, wherein said fluid release agent further comprises nonfunctional molecules as diluent.

16. An image forming apparatus for forming images on a recording medium comprising:

a charge-retentive surface to receive an electrostatic latent image thereon;

a development component to apply toner to said charge-retentive surface to develop said electrostatic latent image to form a developed image on said charge retentive surface;

a transfer component to transfer the developed image from said charge retentive surface to a copy substrate; and a fuser member for fusing toner images to a surface of said copy substrate, wherein said fuser member comprises: a) a substrate; and thereover b) a filled polymeric outer layer comprising a polymer having a zinc compound dispersed therein; and thereover c) a fluid release agent comprising amino functional polyorganosiloxane molecules, wherein at least about 30 percent of the polyorganosiloxane molecules in the fluid release agent have only one substituted amino group per polyorganosiloxane molecule.

17. The image forming apparatus in accordance with claim 16, wherein said toner is a color toner.

* * * * *